US005417366A

United States Patent [19]

Hanko et al.

[11] Patent Number: 5,417,366

[45] Date of Patent: May 23, 1995

[54] COLLAPSED CARTON TUBE AND ICE CREAM CARTON FORMED THEREFROM

[75] Inventors: Jimmy J. Hanko, Lexington, Ky.; William E. Pocta, Coker; Richard F. Gulliver, Tuscaloosa, both of Ala.

[73] Assignee: Gulf States Paper Corporation, Tuscaloosa, Ala.

[21] Appl. No.: 97,012

[22] Filed: Jul. 27, 1993

[51] Int. Cl.[6] ..... B65D 5/54

[52] U.S. Cl. ..... 229/227; 229/154; 229/905

[58] Field of Search ..... 229/227, 226, 224, 930, 229/905, 145, 154, 134

[56] References Cited

U.S. PATENT DOCUMENTS

| | | | |
|---|---|---|---|
| 1,081,724 | 12/1913 | De Smith | 229/930 X |
| 3,281,054 | 10/1966 | Buttery et al. . | |
| 3,281,057 | 10/1966 | Buttery | 229/227 X |
| 3,735,916 | 5/1973 | Buttery . | |
| 4,239,115 | 12/1980 | Froom | 229/227 X |
| 4,555,027 | 11/1985 | Froom | 229/227 |
| 4,712,689 | 12/1987 | Froom . | |
| 4,749,086 | 6/1988 | Donohie | 229/227 |
| 4,757,902 | 7/1988 | Hutchinson et al. . | |
| 4,826,074 | 5/1989 | DePaul . | |
| 4,838,432 | 6/1989 | DePaul . | |
| 4,872,609 | 10/1989 | DePaul . | |
| 4,907,698 | 3/1990 | Konrad et al. . | |
| 5,160,082 | 11/1992 | McCormick et al. | 229/227 X |

*Primary Examiner*—Allan N. Shoap
*Assistant Examiner*—Christopher J. McDonald
*Attorney, Agent, or Firm*—Cushman, Darby & Cushman

[57] ABSTRACT

A collapsed carton tube comprising hingedly connected bottom, front, rear, cover, front flap wall panels, and a pair of end assemblies. The end assemblies include hingedly connected bottom, front, cover, rear, and front flap wall panel end flaps. The end flaps are moveable in the following order into a closed position over end portions of the tube. First, the bottom wall panel end flaps substantially close the tube end portions. Second, the front wall panel end flaps overlap a front portion of the bottom wall panel end flaps with a rear portion exposed. Third, the cover wall panel end flaps, including a recess in a rear lower corner thereof, overlap an upper portion of the front wall panel end flaps and an upper rear corner portion of the bottom wall panel end flaps, the recess leaving exposed an upper portion of the exposed rear portion of the bottom wall panel end flaps below the overlapped upper rear corner portion and rearwardly of the overlapped upper portion thereof. Fourth, the rear wall panel end flaps overlap a marginal edge portion of the cover wall panel end flaps defining the recess, a rear portion of the front wall panel end flaps, and substantially the entire exposed rear portion of the bottom wall panel end flaps. Finally the front flap wall panel end flaps overlap a front portion of the cover wall panel end flaps. An adhesive maintains the end flaps in a closed position.

34 Claims, 7 Drawing Sheets

30
54
110
52
53
50
56
76
78
40
78
76
48
74
74
84
72
38
72
84
82
82
80
86
46
86
80
88
90
90
88
94
94
70
36
70
b
92
68
68
92
44
67
96
96
65
98
98
60
62
32
a
62
60
c
d
42
61
63
64
66
34
66
64
102
104
100

Fig. 5C
Fig. 5B
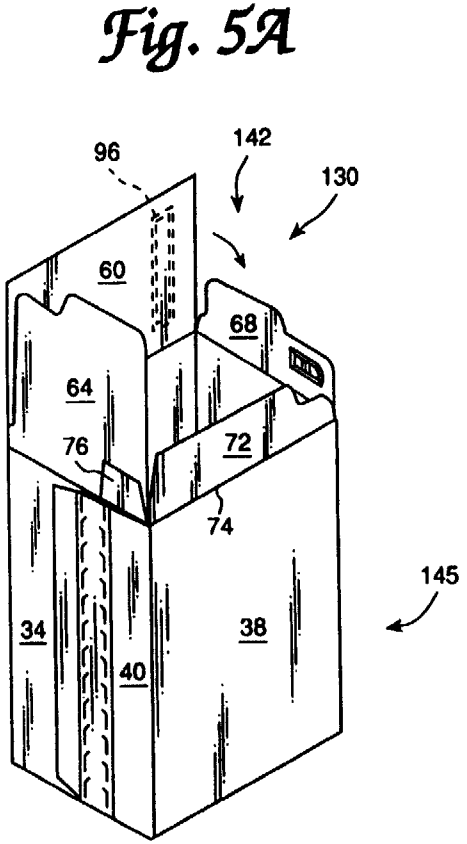
Fig. 5A
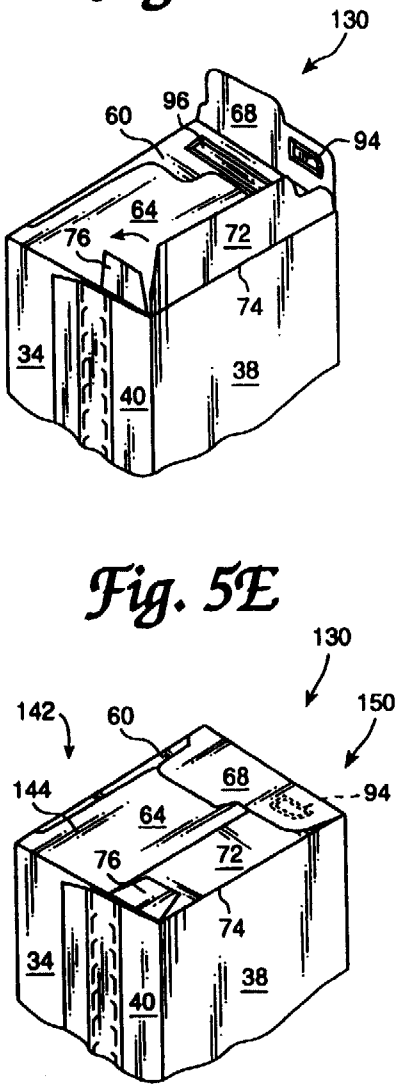
Fig. 5E
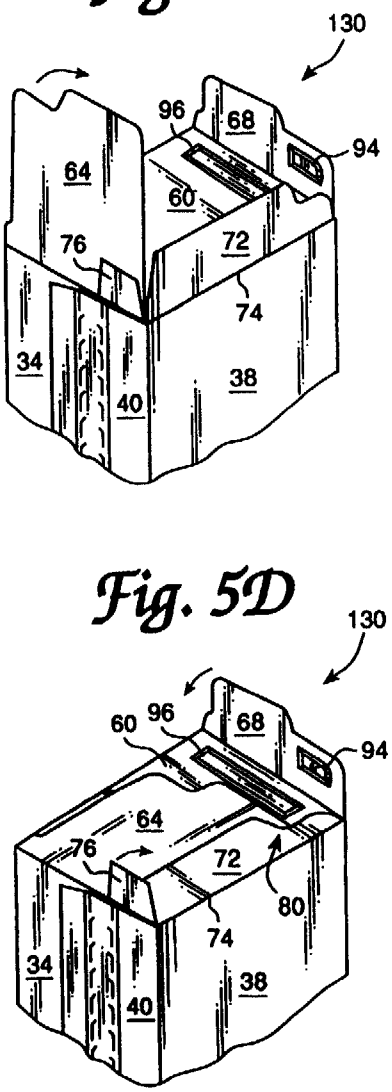
Fig. 5D

COLLAPSED CARTON TUBE AND ICE CREAM CARTON FORMED THEREFROM

This invention relates to carton-type containers suitable for packaging ice cream and the like wherein and, in particular, to an end assembly for closing and sealing the ends of a carton wherein end flaps forming the end assembly are maintained in close relation to the carton while enabling the carton to be easily opened and closed.

Cartons have been developed that are particularly suited for packaging ice cream and the like therein. Such cartons are formed from carton blanks that include a series of panels. Prior to shipping, the carton manufacturing company folds the panels relative to one another and attaches them together to form a collapsed parallelogram. The collapsed parallelogram is then shipped to food packaging companies. The food packaging companies erect the collapsed parallelograms into carton tubes, close one end of the tubes to form partially erected cartons, fill the partially erected cartons through the remaining open end, and then close the open end to form a filled carton packages.

Of importance in the above-described packaging process is the closing and sealing of the ends of the carton tube. The sequence in which the end flap panels at the ends of the tube are closed must conform to existing folding sequences so that new cartons can be erected using existing machinery. Additionally, the closed ends of the tube must provide a sufficiently tight sealed end to prevent leaking of ice cream or the like therefrom while also providing aesthetically pleasing carton ends suitable to place indicia thereon. Furthermore, because a common method of opening ice cream packages to access the ice cream therein involves moving a hooded cover wall panel from a closed position to an open position, it is desirable that the hooded cover be easily openable without compromising the structural integrity of the carton package.

Two types of end assemblies for closing the ends of a carton tube are known. The first type of end assembly is typified by U.S. Pat. Nos. 3,281,054; 3,735,916; 4,712,689; 4,757,902; 4,838,432; and 4,907,698. The cartons disclosed in the aforementioned patents include an end assembly wherein a portion of the cover wall panel end flaps is adhesively adhered to the underlying or overlapping end flap or flaps. In a common embodiment of this arrangement, the rear portion of the cover wall panel end flaps is adhered to the overlying rear wall panel end flaps. This specific type of end assembly has the advantage in that the rear portion of each of the cover wall panel end flaps is relatively tightly sealed to the carton package thereby minimizing leaks at the end portions thereof.

A disadvantage associated with this end assembly, however, is that the cover wall panel end flaps must include a structure that enables the portion of the cover wall panel end flaps adhered to the underlying/overlapping end flaps to be detached from the rest of the cover wall panel end flap panels in order to move the hooded cover of the ice cream carton to an open position. Various structures exist for detaching a portion of the cover wall panel end flaps from the remainder of the cover wall panel end flap. One common structure, for example, includes perforations provided in the cover wall panel end flap enabling the portion of the cover wall panel end flap adhered to the overlapping or underlying end flaps to detach from the remainder of the cover wall panel end flap. Opening the hooded cover requires the user to manually actuate the perforations thereby detaching the adhered portion of the cover wall panel end flaps from the rest of the cover wall panel end flaps. As a result, opening the carton package is difficult and may compromise the structural integrity of the carton package.

The second type of end assembly for closing the ends of a carton tube is typified by U.S. Pat. Nos.4,712,689; 4,826,074; and 4,872,609. In the aforementioned patents, the rear portion of the cover wall panel is not adhered to the underlying or overlying end flaps. Instead, the rear portion of the cover wall panel end flaps underlie the upper portion of the rear wall panel end flaps so that the rear portion of the cover wall panel end flaps are movable relative to upper portion of the rear wall panel end flaps as the hooded cover is opened and closed. This arrangement has the advantage in that opening the cover of the carton package is accomplished without the necessity of detaching a portion of the cover wall panel end flaps from the remainder of the cover wall panel end flaps. However, the upper portion of the rear wall panel end flaps overlying the rear portion of the cover wall panel end flaps have a tendency to obstructively protrude from the ends carton package. As a result, the aesthetic appearance of the carton is diminished, which is especially undesirable if indicia are provided on the end portions of the carton. The protruding portion of the rear wall panel end flaps can also render the carton package difficult to handle, store, and display.

It is an object of the present invention to provide a carton tube including at least one end assembly which overcomes the problems associated with the existing ice cream cartons as discussed above. In accordance with the principles of the present invention, this objective is achieved by providing a collapsed carton tube formed from a carton blank. The collapsed carton tube comprises hingedly connected bottom, front, rear, cover, and a front flap wall panels forming a collapsed parallelogram openable into a carton tube having a pair of end assemblies at each end thereof. The end assemblies include hingedly connected bottom, front, cover, rear, and front flap wall panel end flaps. The end flaps forming the end assemblies are moveable in the following order into a closed position over the end portions of the carton tube. First, the bottom wall panel end flaps first are moveable to substantially close the end portions of the carton tube. Second, the front wall panel end flaps are moveable to overlap a front portion of the bottom wall panel end flaps with a rear portion exposed. Third, the cover wall panel end flaps, including a recess in a rear lower corner thereof, are movable to overlap an upper portion of the front wall panel end flaps and an upper rear corner portion of the bottom wall panel end flaps with the recess leaving exposed an upper portion of the exposed rear portion of the bottom wall panel end flaps below the overlapped upper rear corner portion and rearwardly of the overlapped upper portion thereof. Fourth, the rear wall panel end flaps are moveable to overlap a marginal edge portion of the cover wall panel end flaps defining the recess, a rear portion of the front wall panel end flaps, and substantially the entire exposed rear portion of the bottom wall panel end flaps. Finally, the front flap wall panel end flaps are moveable to overlap a front portion of the cover wall panel end flaps. The end flaps are maintained in a closed position by an adhesive provided thereon such that the adhesive extends into the recess in the lower rear portion of the cover wall panel end flaps.

It is a further object of the present invention to provide a carton package containing ice cream or the like therein formed from the above-described carton tube having the end assemblies formed in a closed position.

It is a still further object of the present invention to provide a carton tube which has at least one end flap which is outwardly foldable therefrom so that the carton tube does not tilt as it is being filled.

It is a yet another object of the present invention to provide a carton-type package which is simple in construction, economical in manufacture, effective in operation, and designed such that accessing the contents of the carton package by opening the hooded cover does not impair the structural integrity of the carton or damage the contents therein.

These and other objects of the present invention will become more apparent during the course of the following detailed description and appended claims.

The invention may best be understood with reference to the accompanying drawings, wherein illustrative embodiments are shown.

IN THE DRAWINGS

Figure 6B:
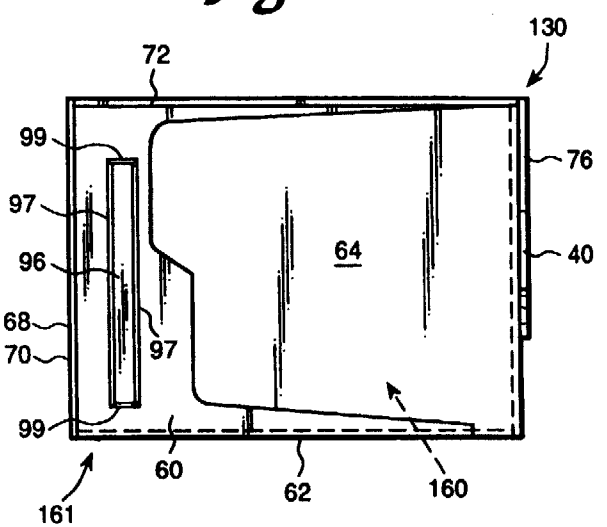
Figure 6D:
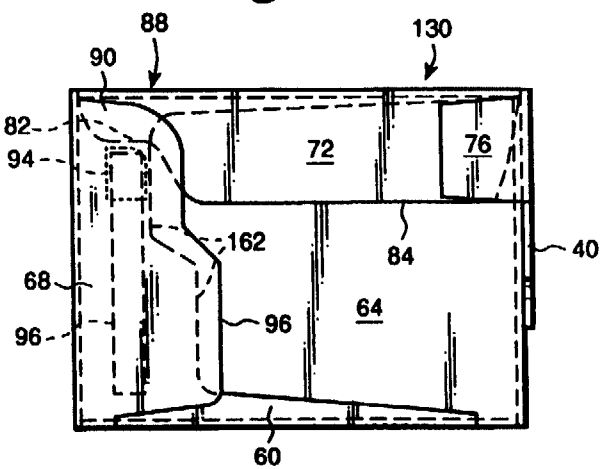
Figure 6A:
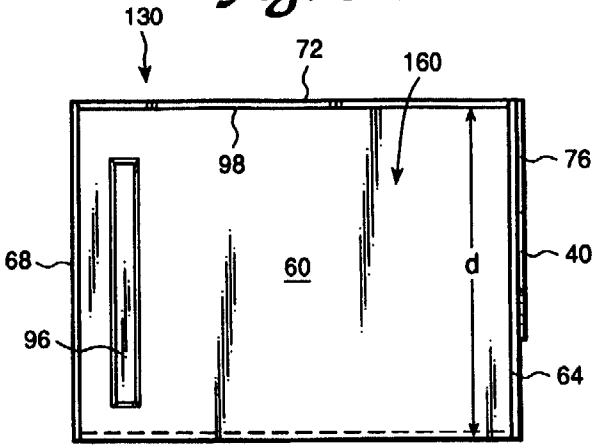
Figure 6C:
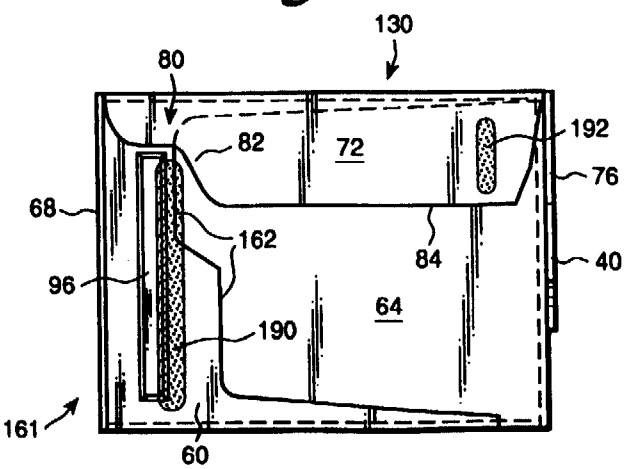
Figure 7:
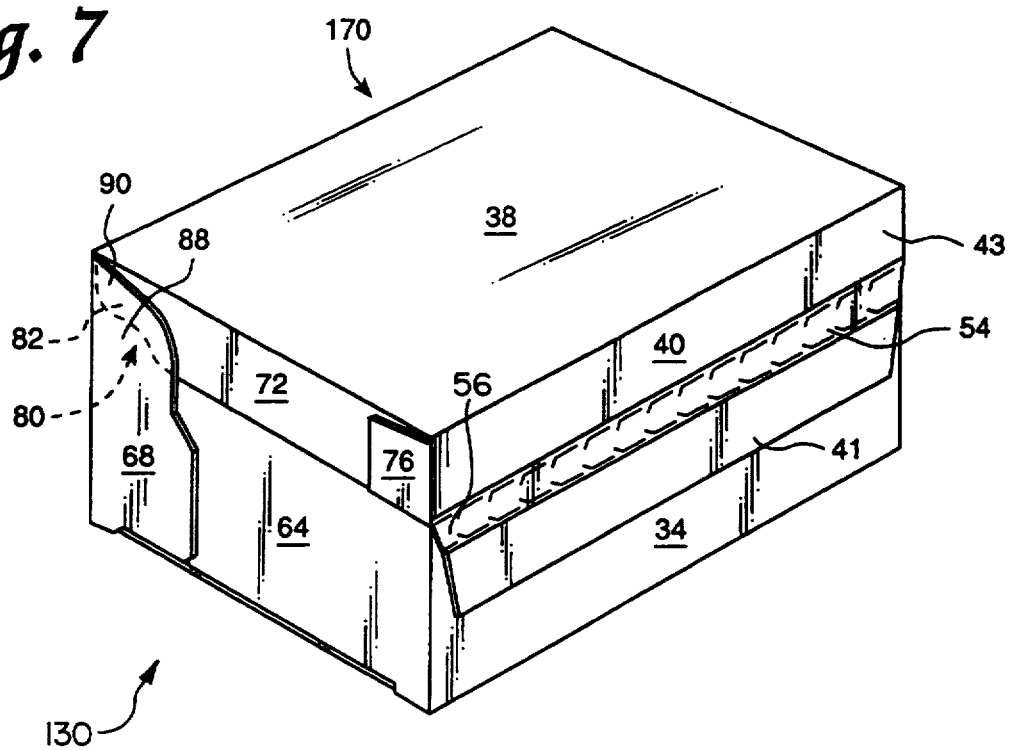
Figure 8:
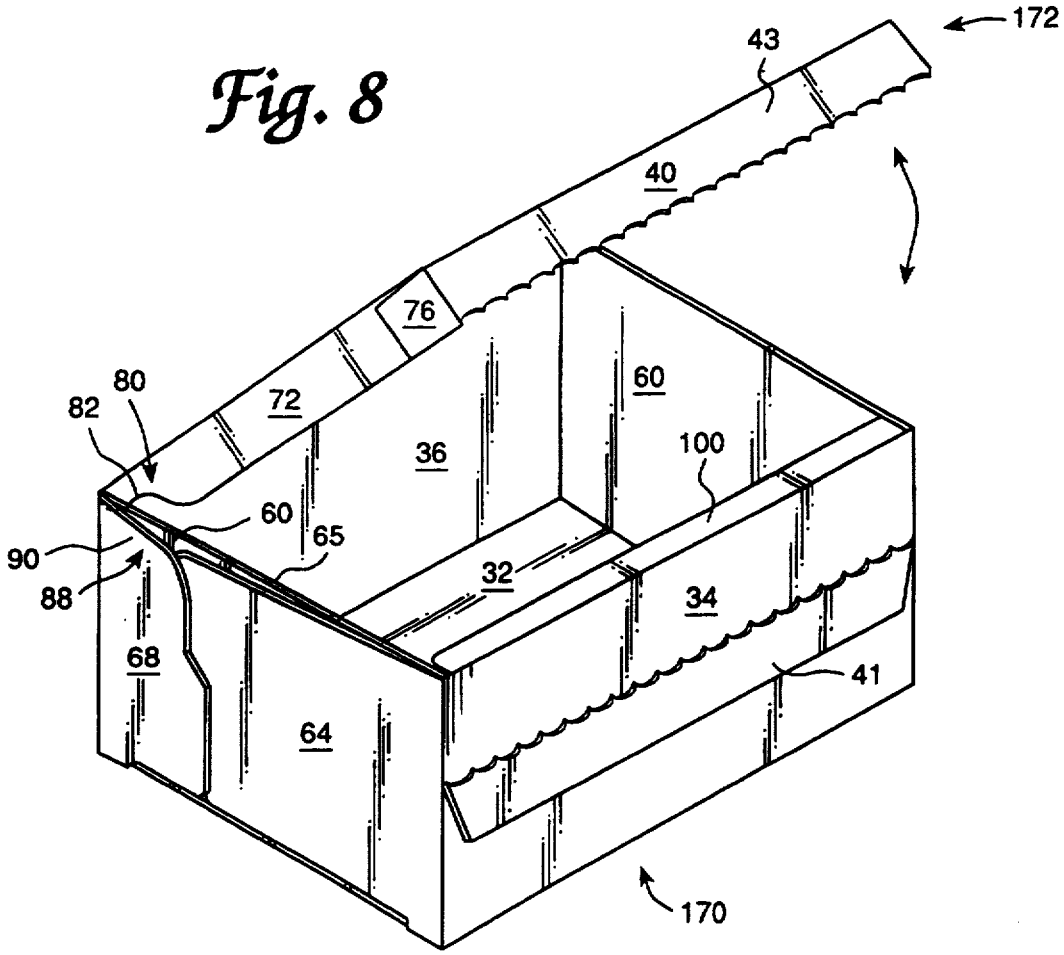

FIGS. 5*a*–5*e* are perspective views of a partially erected carton showing the sequence in which the end flaps of an end assembly are closed;

FIG. 6*a* is side view of a carton showing the bottom wall panel end flap in its folded position;

FIG. 6*b* is a side view of a carton showing the bottom wall panel and front wall panel end flaps in their folded positions;

FIG. 6*c* is a side view of a carton showing the bottom wall panel, front wall panel, and cover wall panel end flaps in their folded positions;

FIG. 6*d* is a side view of a carton showing all of the end flaps in their folded positions;

FIG. 7 is a perspective view of an erected carton according to the principles of the present invention; and FIG. 8 is perspective view of the erected carton shown in FIG. 7 with the hooded cover in an open position.

Figure 1:
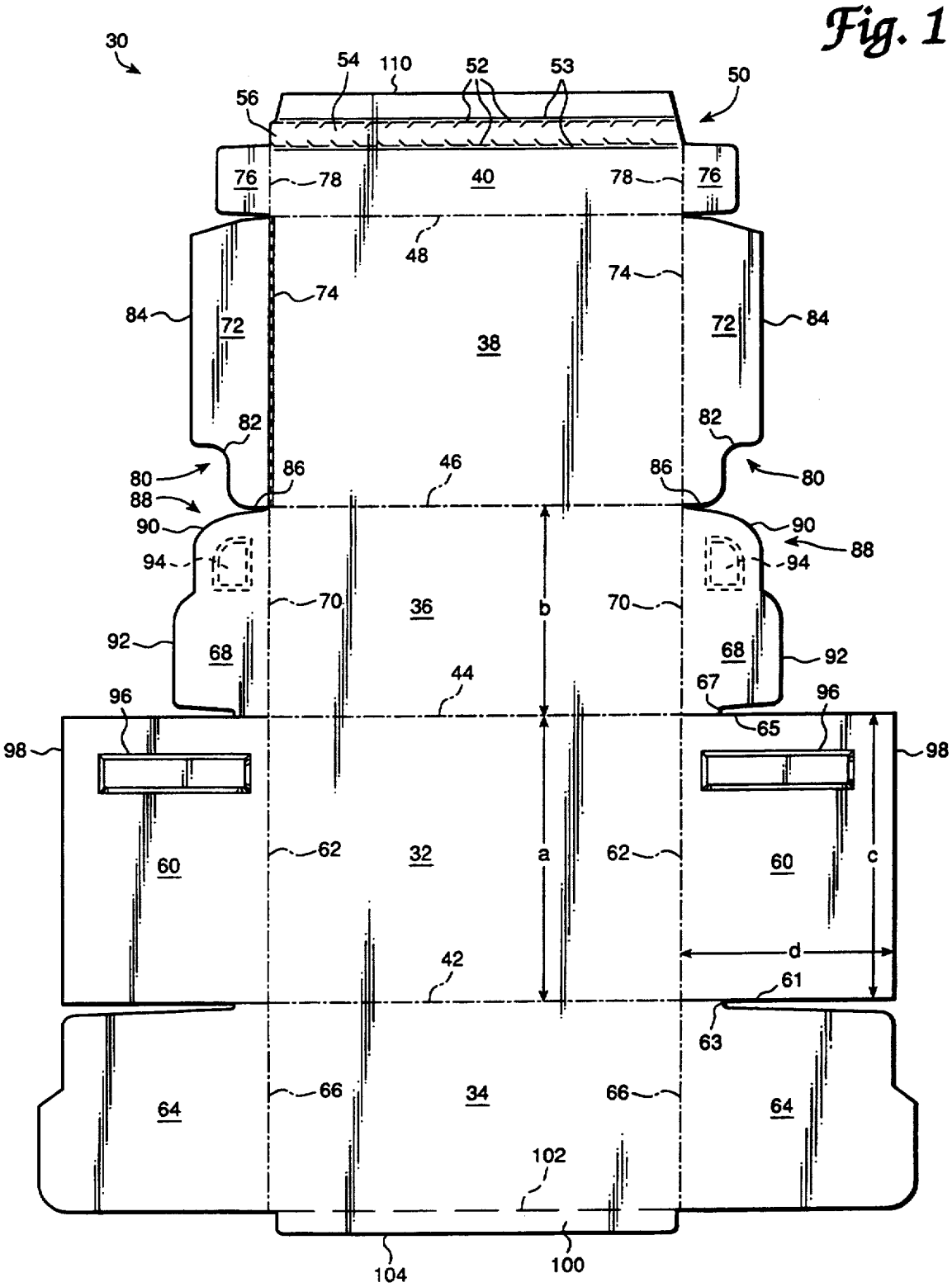
FIG. 1 is a top plan view of a carton blank cut and scored for assembly into a carton package according to the principles of the present invention.

Referring now more particularly to FIG. 1 of the drawings, there is shown therein a carton blank, generally indicated at 30, which is erectable into a collapsed parallelogram according to the principles of the present invention and thereafter erectable into a carton for packaging ice cream and the like therein. The carton blank 30 is formed of any suitable sheet of material as, for example, paperboard. It will be understood that the carton material may be in the form of a laminate, such as a plastic film (e.g., polypropylene or PET) laminated to the paperboard. Preferably, the plastic film is provided on both the interior and exterior surfaces of the paperboard carton blank. It is to be understood, however, that the laminate may be omitted from the areas of the carton blank 30 where an alternative type of adhesive material is to be applied.

As shown, the carton blank 30 is suitably cut and/or scored to provide a bottom wall panel 32, a front wall panel 34, a rear wall panel 36, a cover wall panel 38, and a front flap wall panel 40. As shown, the front wall panel 34 is hingedly connected to the bottom wall panel 32 along a front wall panel fold line 42. The rear wall panel 36 is hingedly connected to the bottom wall panel 32 along a rear wall panel fold line 44. The cover wall panel 38 is hingedly connected to the rear wall panel 36 along a cover wall panel fold line 46. The front flap wall panel 40 is hingedly connected to the cover wall panel 38 along a front flap wall panel fold line 48. The fold lines 42, 44, 46 and 48 may be of any desired construction, an exemplary embodiment being regular barscores as viewed from the side of the carton blank 30 forming the exterior of the carton package. The regular barscores are indicated in FIG. 1 by a solid line broken at intervals with a short dash. The side of the carton blank 30 shown in FIG. 1 corresponds to the exterior surface of the carton package formed by erecting the carton blank 30.

The front flap wall panel 40 includes an opening means, generally indicated at 50, which enables a portion of the front flap wall panel 40 to be detached therefrom during a manual cover wall panel detaching procedure so that the cover wall panel 38 and associated end flaps 72 can be moved into an open position for accessing the contents of the carton package formed from the carton blank 30. As shown, the opening means includes a series of parallel perforations 52 and a series of parallel partial depth cuts 53. The perforations 52 and partial depth cuts 53 are disposed in the front flap wall panel 40 along a predetermined perforation path defining a tear-away strip 54 within a portion of the front flap wall panel 40. The tear-away strip 54 includes a tab portion 56 at one end thereof capable of being manually gripped as an initial step in a manual cover wall panel detaching procedure. As shown, the partial depth cuts 53 are generally parallel to the perforations 52 and disposed outwardly therefrom.

The bottom wall panel 32 includes a pair of bottom wall panel end flaps 60 integral therewith along bottom wall end flap fold lines 62. The front wall panel 34 includes front wall panel end flaps 64 integral therewith along front wall panel end flap fold lines 66. The rear wall panel 36 includes rear wall panel end flaps 68 integral therewith along rear wall panel end flap fold lines 70. The cover wall panel 38 includes cover wall panel end flaps 72 integral therewith along cover wall panel end flap fold lines 74. The front flap wall panel 40 includes front flap wall panel end flaps 76 integral therewith along front flap wall panel fold lines 78. The end flap fold lines 62, 66, 74, and 78 are formed by regular barscores. In a preferred embodiment of the present invention, however, at least one of the cover wall panel end flap fold lines 74 is reverse barscored, i.e. barscored on the side of the paperboard opposite that shown in FIG. 1. Reverse barscores are illustrated in FIG. 1 by parallel solid lines surrounding a dashed line. The other cover wall panel end flap fold line being regular barscored.

The cover wall panel end flaps 72 include a recess therein, generally indicated at 80. The recess 80 is disposed at an exterior corner of the cover wall panel end flap 72 at an end thereof proximate to the cover wall panel fold line 46. The recess 80 is defined by a marginal edge portion 82 extending from an outer edge 84 of the cover wall panel end flap 72 to a rear edge 86 thereof.

The rear wall panel end flaps 68 include an arcuate corner arrangement, generally indicated at 88, disposed at an end thereof proximate to the cover wall panel fold line 46. The arcuate corner arrangement 88 is defined by an outer edge portion 90 extending between the outer edge 92 of the rear wall end flaps 68 to the confluence of fold lines 46, 70 and 74. In an exemplary embodiment of the present invention, the rear wall panel end flaps 68 include a generally rectangular shaped debossed portion 94 centrally located in the arcuate corner arrangement 88 of the end portion of the cover wall panel end flaps 68 and illustrated by parallel dashed lines. The debossed portion 94 provides a raised surface on the interior surface of the rear wall panel end flaps 68.

In an exemplary embodiment, the bottom wall panel end flaps 60 include an embossed portion 96, illustrated by parallel solid lines. As shown, the embossed portion 96 is generally rectangular-shaped and extends substantially between the bottom wall panel end flap fold lines 62 and the outer edges 98 of the bottom wall panel end flaps 60. The embossed portion 96 is disposed at an end of the bottom wall panel end flap 60 proximate the rear wall panel fold line 44 and provides a raised surface on the exterior surface of the bottom wall panel end flaps 60.

Also in an exemplary embodiment of the present invention, the width, a, of the bottom wall panel 32 is 4-53/64" and the width, b, of the rear wall panel 36 is 3½". In a first embodiment of the present invention, the length, c, of the bottom wall panel end flap 60 matches the width, a, of the bottom wall panel 32, i.e. 4-53/64". In a second embodiment, however, the length, c, is slightly less than the width, a, for example 4-51/64". In this case, the edge 61 of the bottom wall panel end flap 60 is angled from the intersection of fold lines 42, 62, and 66 toward the center of the bottom wall panel end flap 60 to the hairpin 63, thus enabling the length, c, of the bottom wall panel end flaps 60 to be slightly reduced. It is to be understood that the opposite edge 65 of the bottom wall panel end flap 60 may be similarly angled to achieve the desired amount of taper thereby reducing the length, c, to the desired amount.

Furthermore, the width, d, of the bottom wall panel end flap 60 may vary depending on the desired amount of overlap of the bottom wall panel end flap over the end of the carton tube formed by erecting the carton blank 30. For example, the width, d, may be equivalent to the width, b, of the rear wall panel, i.e. 3-½". Alternatively, the width, d, may be, slightly greater than the width, b, 3-33/64" for example, so that the outer edge 98 of the bottom wall panel end flap 60 slightly overlaps the cover wall panel end flap fold lines 74 when the carton blank 30 is erected. In this case, the concave groove formed by the reverse barscore in the cover wall panel end flap fold line 74 serves to receive the outer edge 98 of the bottom wall panel end flap. The above-described variations for the length, c, and width, d, of the bottom wall panel end flaps may be made individually or jointly, depending on the desired overlap of the bottom wall panel end flap over the end of the carton tube formed from the carton blank 30.

In a preferred embodiment of the present invention, the front wall panel 34 includes a lip portion 100 integral therewith along a lip fold line 102. The lip fold line 102 is perforated so as to enable the lip portion 100 to be folded in an inward direction with respect to the bottom wall panel 32 such that an outer edge 104 of the lip portion engages an interior surface of the cover wall panel 38 when the carton blank 30 is erected. In an alternative embodiment of the present invention, the front wall panel 34 includes a recessed portion (not shown) along the edge corresponding to the lip fold line 102 in place of the lip 100.

The carton blank 30, in an exemplary embodiment, includes an adhesive applied to the interior surface of the front flap wall panel 40 and/or the exterior surface of the front wall panel 34. The adhesive may be applied in a generally rectangular pattern between the outer edge 110 of the front flap wall panel 40 and the outermost series of partial depth cuts 53 and/or the adhesive may be applied to the front wall panel 34 corresponding to the portion the front flap wall panel 40 between the outermost series of partial depth cuts 53 and the edge 110 when the carton blank 30 is an erect position.

Figure 2:
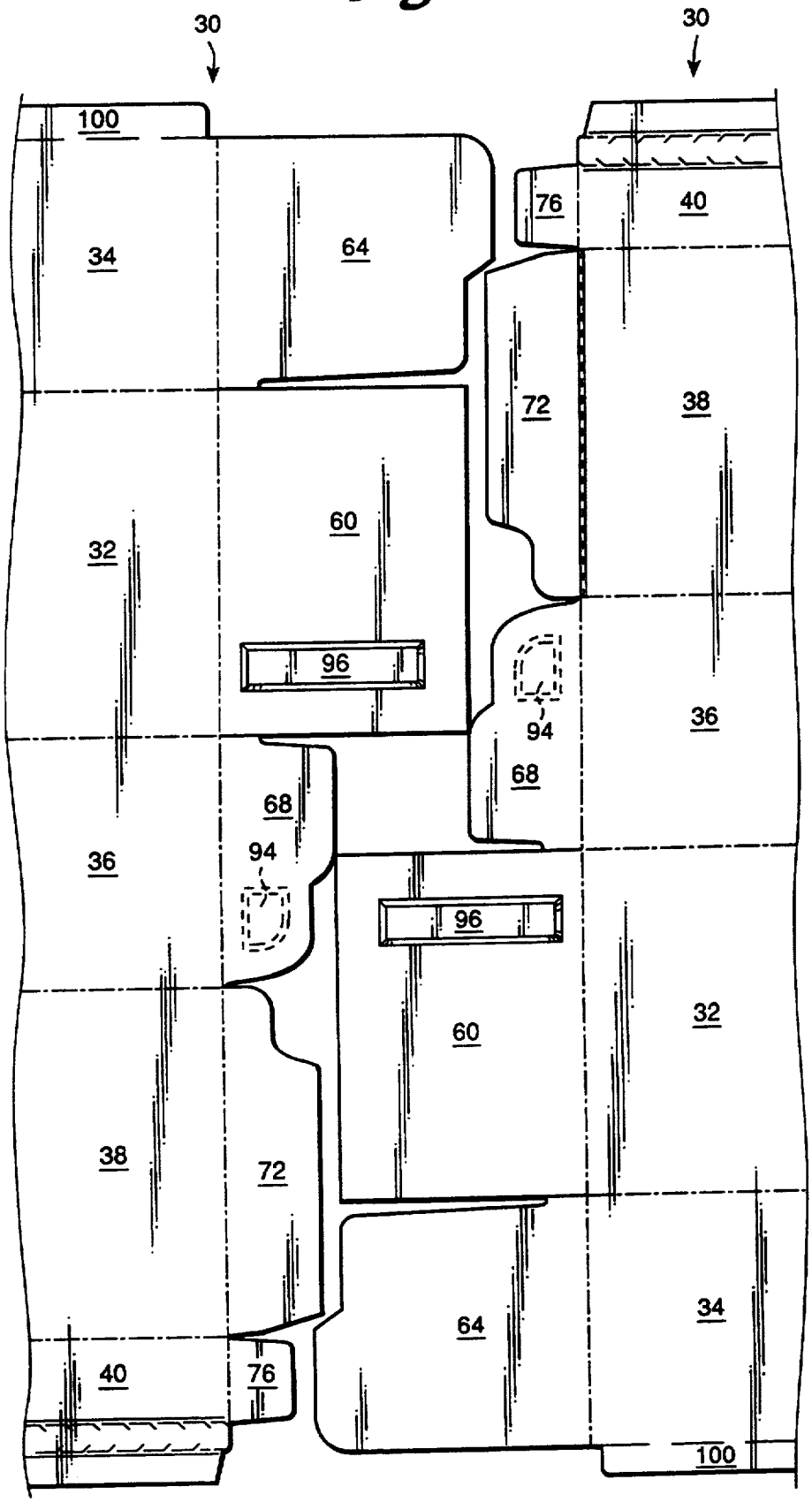
FIG. 2 is a top plan view of two of the carton blanks shown in FIG. 1 showing how the blanks are cut and scored from a sheet of carton material.

Referring to FIG. 2, a pair of carton blanks 30 are illustrated as oriented during the blanking operation in which the carton blank 30 of FIG. 1 is formed.

Figure 3:
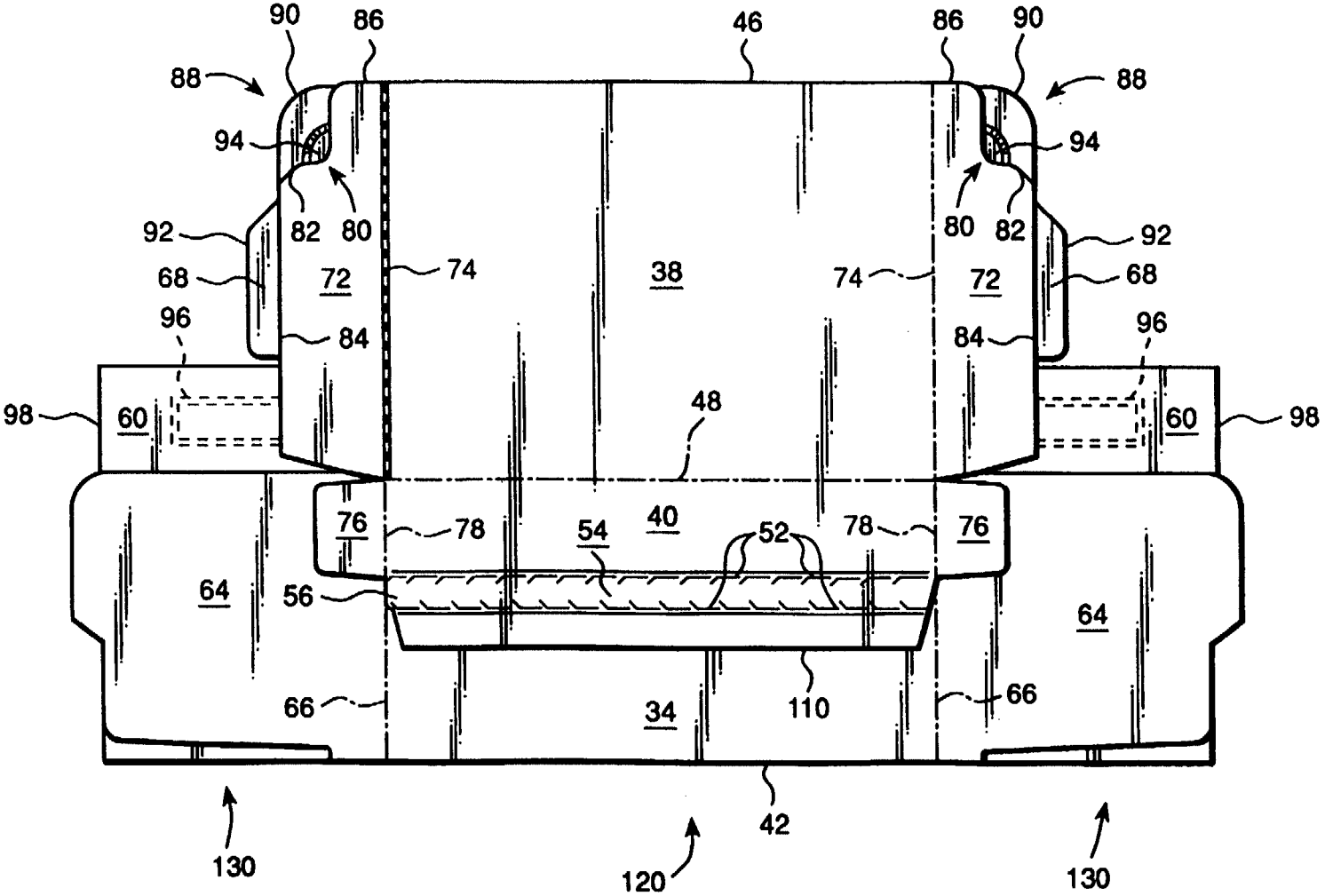
FIG. 3 is a top plan view of a collapsed carton tube formed from the carton blank shown in FIG. 1.

Referring now to FIG. 3, there is shown therein a collapsed carton tube, generally indicated at 120, formed from the carton blank 30 of FIG. 1, wherein like parts are identified by like numerals. The collapsed carton tube 120, which is generally shaped like a collapsed parallelogram when viewed from the side, is formed by folding the front wall panel 34 along the front wall panel fold line 42 in an inward direction with respect to the interior surface of the bottom wall panel. When so folded, the interior surface of the front wall panel 34 abuts the interior surface of the bottom wall panel. The interior surfaces of the end flaps 60 and 64 also abut one another. The cover wall panel 38 is also folded along the cover wall panel fold line 46 in an inward direction with respect to bottom wall panel 32 such that the interior surface of the front flap wall panel 40 is in a surface-to-surface abutting relation with the exterior surface of the front wall panel 34. The exterior surface of the lip portion abuts the interior surface of the cover wall panel 38 at a portion proximate to the front flap wall panel fold line 48. The collapsed carton tube 120 includes end assemblies, generally indicated 130, which are discussed in greater detail below. It is to be understood that a plastic liner may be provided on the interior surface of the collapsed parallelogram corresponding to the interior surfaces of the front flap wall panel 40, the cover wall panel 38, and the rear wall panel 36. The plastic liner is maintained in this position by, for example, an adhesive selectively applied to these surfaces.

The carton blank is maintained in the collapsed parallelogram form by adhesively adhering the front wall panel 34 to the front flap wall panel 40 such that an interior surface portion of the front flap wall panel 40 between the outermost series of the partial depth cuts 53 and the edge 110 is adhered to a portion of the exterior surface of the front wall panel 34. The adhesive utilized may be of any type including either heat activated or pressure activated adhesives. The adhesive may be separately applied to the carton blank 30 prior to forming a collapsed carton tube 120 or applied as the carton blank 30 is erected into the collapsed carton tube 120. It is to be understood that where the carton material comprises a laminate including a plastic film on the interior and exterior surfaces of the paperboard, portions of the plastic film itself may constitute the adhesive which is activated by heat, and preferably by directing a stream of hot air located thereto just prior to the above described erecting procedure.

Figure 4:
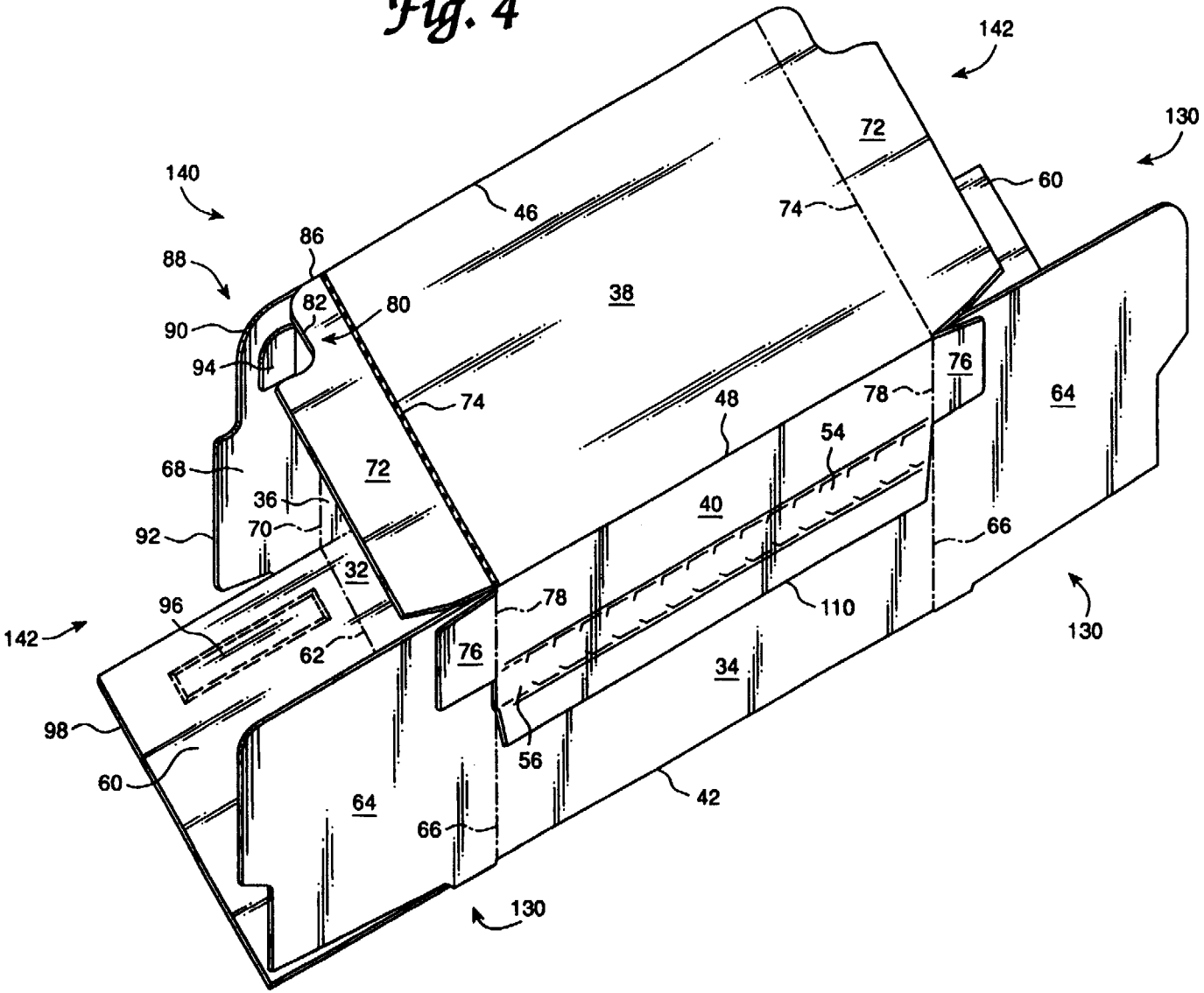
FIG. 4 is a perspective view of a carton tube formed by opening the collapsed carton tube shown in FIG. 3.

Referring now to FIG. 4, there is shown therein a carton tube, generally indicated at 140, which is formed by opening the collapsed parallelogram-shaped carton tube 120 of FIG. 3. The carton tube 140 surrounds a container space defined by the bottom wall panel 32, front wall panel 34, rear wall panel 36, and cover wall panel 38. The tube 140 includes end portions, generally indicated at 142, on opposite ends thereof. Closing the end portions 142 is achieved by sequentially folding the end flaps forming the end assemblies 130. As shown, the end flaps in the end assemblies 130 are the bottom wall panel end flaps 60, front wall panel end flaps 64, rear wall panel end flaps 68, cover wall panel end flaps 72 and front flap wall panel end flaps 76.

Before filling the carton tube 140 with edible contents, one of the end assemblies 130 is sequentially folded into a closed portion over the corresponding end portion 142 of the carton tube 140 to form a partially erected carton tube (See FIG. 5*a*). The partially erected carton is then supported on its closed end with the remaining open end serving to accept the edible contents. In an exemplary embodiment of the present invention, the cover wall panel end flap 72 at the open end of the tube is folded away from the carton tube 140 such that the exterior surface of the cover wall panel 38 and the exterior surface of the cover wall panel end flap 72 are proximate one another. The folded over cover wall panel end flap 72 serves as the leading edge of the partially erected carton as it enters the filling station and engages a positioning member, which positions the partially erected carton under the filling head.

The filling head enters the partially erected carton through the open end and begins discharging the edible contents therein. The filling head is gradually removed from the partially erected carton at the same time the discharge takes place. After the discharge is complete, the filling head is completely removed from the partially erected carton and the open end of the filled carton is closed, thereby forming a filled carton package.

To ensure that the outwardly folded cover wall panel end flap properly engages the positioning member, thereby preventing tilting of the carton tube under the filling head during filling, the cover wall panel end flap fold line 74, in an exemplary embodiment of the present invention, is reverse barscored, i.e. barscored on the surface of the carton blank corresponding to the interior surface of the carton when the blank is erected. The reverse barscore enables the cover wall panel end flap 72 to be outwardly folded against the cover wall panel such that a minimal amount of springiness exists in the flap 68 so that it properly engages the positioning member.

Referring now to FIGS. 5*a*–5*e*, there is shown therein the sequence in which the end flaps of an end assembly 130 are folded to thereby close an end portion 142 of a partially erected carton, generally indicated at 145. As shown, the bottom wall panel end flap 60 is first folded to substantially close the end portion 142 of the carton tube 140 (FIG. 5*b*). It is to be understood that where the width of the bottom wall panel end flap 60 is slightly larger that the width of the rear wall panel 68, as previously discussed, a tighter end flap seal is formed by the bottom wall panel end flap 60. When so folded, a portion the exterior surface of the bottom wall panel end flap 60 corresponding to the embossed portion 96 is raised outward from the partially erected carton 145. Next, the front wall panel end flap 64 is folded such that the front wall panel end flap 64 overlies a front portion of the bottom wall panel end flap 60 (FIG. 5*c*). The cover wall panel end flap 72 is then folded such that it overlaps the previously folded end flaps (FIG. 5*d*). Where the bottom wall panel end flap is dimensioned slightly larger that the rear wall panel, the reverse barscore in the cover wall panel end flap fold line 74 enables the cover wall panel end flap 72 to be folded in place despite the overlap of the outer edge of the bottom wall panel end flap on the cover wall panel end flap fold line. This is so because the reverse barscore provides a concave groove into which the outer edge of the bottom wall panel end flap is received. Finally, the rear wall panel end flap 68 and the front flap wall panel end flap 76 are folded into a closed position, thereby fully enclosing the end portion 142 of the carton tube so as to define an end 144 of a carton package, generally indicated at 150 (FIG. 5*e*).

When the rear wall panel 68 is folded into a closed position, the debossed portion 94 abuts the embossed portion 96 of the bottom wall panel end flap 60 in the area of the recess 80 in the cover wall panel end flap 72. It is to be understood that both ends of the carton tube can be closed in this manner. However, it is sufficient for purposes of the present invention that only the end portion of the partially erected carton tube through which the edible contents are delivered be closed using the above described closing procedure. That is, the first end portion of the carton tube to be closed may be closed using any conventional method.

The end flap assembly 130, once closed, is maintained in the closed position by an adhesive. In an exemplary embodiment of the present invention, as shown in FIG. 6*c*, two adhesive strips 190 and 192 are applied to the end flaps forming the end assembly. The first adhesive strip 190 is applied to the bottom wall panel 60 in an area corresponding to the embossed portion 96. The adhesive strip 190 overlaps a portion of the outer edge portion 162 of the front wall panel end flap 64 and extends along the edge of the embossed portion 96 into the recess 80 above the outer edge 84 of the cover wall panel end flap 72. The adhesive strip 190 does not contact the cover wall panel 72. The adhesive strip 190 forms a bonding relation between the exterior surfaces of the bottom wall panel end flap 60 and the interior surface of rear wall panel end flap 68. The slight overlap of the front wall panel end flap also enables a bonding relation to be formed between the front wall panel end flap 64 and the rear wall panel end flap 68. The second adhesive strip 192, in an exemplary embodiment, is applied to the front portion of the cover wall panel end flap 72 prior to folding the front flap wall panel end flap 76. The second adhesive strip 192 forms a bonding relation between the front portion of the cover wall panel end flap 72 and the front flap wall panel end flap 76. It is to be understood that additional adhesive strips may be applied to the end flaps forming the end assembly 130 and/or the adhesive may be applied in a variety of patterns thereon. However, these additional adhesive strips add to the cost of carton package.

It is to be understood that the adhesive utilized to secure the end assemblies 130 in a closed position may be of any type including either heat activated or pressure activated adhesives. The adhesive may be separately applied to the carton blank prior to forming the collapsed parallelogram or applied as the end assemblies are erected to close the end portions 142 of the carton.

In a preferred embodiment of the present invention the adhesive utilized is a hot melt type adhesive applied to the surfaces of the end flaps forming the end assembly 130 during the closing procedure.

Referring now to FIGS. *6a–6d*, which are side views of an end portion of the carton showing the end assembly 130 in various stages of closure over the end portion of the carton, the specific relationships of the various end flaps to one another resulting from the closing of the end assembly 130 according to the principles of the present invention is described below. As shown in FIG. *6a*, the bottom wall panel end flap 60 is first folded over the end portion of the carton tube such that the bottom wall panel end flap 60 substantially closes the end portion thereof. As previously mentioned, the bottom wall panel end flap 60 may be dimensioned such that it is slightly larger in width, d, than the width of the opening of the end assembly. In this case, the outer edge 98 slightly overlaps the cover wall panel end flap fold lines and fits into the concave groove formed by the reverse barscore in the cover wall panel fold line, thereby forming a tight seal over the end of the carton.

As shown in FIG. *6b*, the front wall panel end flap 64 is then folded such that the front wall panel end flap 64 overlaps a front portion, generally indicated at 160, of the bottom wall panel end flap 60, leaving exposed a rear portion of the bottom wall panel end flap, generally indicated at 161. The rectangular-shaped embossed portion 96 has sides 97, which are generally parallel to the rear wall panel end flap fold line 70, and sides 99, which are generally parallel to the bottom wall panel end flap fold line 62 when the bottom wall panel and flap 60 is in its closed position.

As shown in FIG. *6c*, the cover wall panel end flap 72 is then folded such that the cover wall panel end flap 72 overlaps an upper portion of the front wall panel end flap 64 and an upper rear corner portion of the bottom wall panel end flap 60. The recess 80 in the cover wall panel end flap 72 leaves exposed an upper portion of the of the exposed rear portion 161 below the overlapped upper rear corner portion and rearwardly of the overlapped upper portion thereof. As shown, the embossed portion 96 extends above the outer edge 84 of the cover wall panel end flap 72 into a portion of the exposed rear portion of the bottom wall panel end flap 60 corresponding the recess 80. As previously discussed, the adhesive strips 190 and 192 are provided to maintain the end flaps forming the end assembly 130 in a bonded relation thereby securely closing the end of the carton package. Also, when the bottom wall panel end flap 60 is dimensioned to slightly overlap the cover wall panel end flap fold line 74, the reverse barscore therein, which was discussed previously, enables the cover wall panel end flap to be folded into its closed position despite this slight overlap by the bottom wall panel end flap along the cover wall panel end flap fold line.

As shown in FIG. *6d*, the rear wall panel end flap 68 and the front flap wall panel end flap 76 are then folded such that the end assembly 130 is closed over the end portion of the carton tube. In the closed position, the outer edge 92 of the rear wall panel end flap 68 overlaps an outer edge portion 162 of the front wall panel end flap 64. Also, the outer edge portion 90 of the corner arrangement 88 of the rear wall panel end flap 68 overlaps a marginal edge portion 82 defining the recess 80. The debossed portion 94 in the corner arrangement 88 is disposed such that the debossed portion 94 is positioned outside of the marginal edge portion 82 of the cover wall panel end flap 72 and overlaps an upper portion of the embossed portion 96 of the bottom wall panel end flap 60. As a result, the surface of the debossed portion 94 and embossed portion 96 are disposed in a surface-to-surface abutting relation when the rear wall panel end flap 68 is in a closed position.

The raised surfaces of the debossed and embossed portions 94 and 96 facilitate adhesive attachment of the upper portion of the rear wall panel end flap 68 to the exposed rear portion of the bottom wall panel end flap 60 corresponding to the cut-out portion 80 of the cover wall panel end flap 72. The debossed and embossed portions 94 and 96 enable a surface-to-surface abutting relationship to be maintained therebetween even though two thicknesses of carton material (i.e. the marginal edge portion 82 and the outer edge 162 of the front wall panel end flaps 64) are disposed between the exposed rear portion of the bottom wall panel end flap 60 and the upper portion of the rear wall panel end flap 68. In a similar manner, the embossed portion 96 provides a surface-to-surface abutting relation with the interior surface of the rear wall panel end flap 68 and the exposed rear portion of the bottom wall panel end flap 60 even though one thickness of carton material (i.e. the outer edge 162 of the front wall panel end flaps 64) is disposed therebetween. In an exemplary embodiment, the bottom edge of the debossed portion 94 terminates along a line corresponding to the outer edge 84 of the cover wall panel end flap 72, and the upper edge thereof is rounded to match the marginal edge portion 82 of the recess 80.

Referring now to FIG. 7 and 8, there is shown therein a carton package, generally indicated at 170, formed from the carton tube of FIG. 4 once the tube has been filled with ice cream or the like, and after both end assemblies 130 have been moved to a closed position. As shown, the marginal edge portion 82 defining the recess 80 in the lower rear corner of the cover wall panel end flap 72 underlies the upper portion of the rear wall panel end flap 68. The marginal edge portions 82 are unobstructively movable with respect outer edge portion 90 of the corner arrangement 88 in the upper portion of the rear wall panel end flaps 68, because the cover wall panel end flaps 72 are not attached to rear wall panel end flaps 68 or the bottom wall panel end flaps 60. As a result, the hooded lid, generally indicated at 172, is easily opened without compromising the structural integrity of the carton package 170. Furthermore, because the upper portion of the rear wall panel end flap 68 is adhered to the bottom wall panel end flap at a portion corresponding to the recess 80, the outer edge portion 90 of the rear wall panel end flap is maintained in close proximity to the carton package 170.

The carton package 170 is opened during a manual opening procedure by first manually grasping a tab portion 56 on the tear-away strip 54. Pulling on the tab portion 56 causes the tear-away strip 54 to detach from the front flap wall panel 40, thereby separating the front flap wall panel 40 into two portions. A first portion 41 of the front wall panel remains attached to the front wall panel 34 while a second portion 43 forms a portion of the hooded lid 172. Thus, the hooded lid 172 is freely movable about the cover wall panel fold line to an open position as shown in FIG. 8 for accessing the contents in the carton package 170. As the hooded lid 172 is opened and closed, the marginal edge portion 82 slides under the upper corner portion of the rear wall panel end flap 68.

While, as shown, it is preferred that the ends of the package are devoid of lips which extend under the cover wall panel, in the broadest aspect of the present invention, the construction principles enunciated above could be embodied in a carton which provides such lips, for example as shown in U.S. Pat. Nos. 4,872,609, 4,757,902 or 4,712,689.

It is also to be understood that the debossed and embossed portions may have different configurations, and that additional embossed and/or debossed portion may be provided. However, it is contemplated by the present invention that the debossed and/or the embossed portions may be eliminated altogether.

It can be seen that the objects of this invention have been fully and effectively accomplished. It will be realized, however, that the foregoing preferred specific embodiment has been shown and described for the purpose of this invention and is subject to change without departure from such principles. Therefore, this invention includes all modifications encompassed within the spirit and scope of the following claims.

What is claimed is:

1. A carton for containing ice cream or the like erected from a collapsed carton tube formed from a carton blank, said carton comprising:

a bottom wall panel, a front wall panel hingedly connected to said bottom wall panel, a rear wall panel hingedly connected to said bottom wall panel, a cover wall panel hingedly connected to said rear wall panel, and a front flap wall panel hingedly connected to said cover wall panel along a front flap wall panel fold line and adhered to the front wall panel; and a pair of end assemblies enclosing end portions of said carton, said end assemblies including bottom wall panel end flaps hingedly connected to said bottom wall panel, front wall panel end flaps hingedly connected to said front wall panel, cover wall panel end flaps hingedly connected to said cover wall panel, rear wall panel end flaps hingedly connected to said rear wall panel, and front flap wall panel end flaps hingedly connected to said front flap wall panel, the end flaps forming each of said end assemblies having been moved in the following order into a closed position over the end portions of the carton, (1) said bottom wall panel end flap first being moved such that said bottom wall panel end flap substantially closes the associated end portion of the carton, (2) next said front wall panel end flap being moved such that said front wall panel end flap overlaps a front portion of said bottom wall panel end flap with a rear portion exposed, (3) then the cover wall panel end flap including a recess in a rear lower corner thereof being moved such that said cover wall panel end flap overlaps an upper portion of said front wall panel end flap and an upper rear corner portion of said bottom wall panel end flap with said recess leaving exposed an upper portion of the exposed rear portion of said bottom wall panel end flap below the overlapped upper rear corner portion and rearwardly of the overlapped upper portion thereof, (4) then the rear wall panel end flap being moved such that an outer edge portion of said rear wall panel end flap overlaps a marginal edge portion of the cover wall panel end flap defining said recess, a rear portion of said front wall panel end flap, and substantially the entire exposed rear portion of said bottom wall panel end flap, and (5) finally the front flap wall panel end flap being moved such that said front flap wall panel end flap overlaps a front portion of said cover wall panel end flap, the end flaps forming each of said end assemblies being maintained in said closed position by an adhesive between the front portion of said cover wall panel end flap and said front flap wall panel end flap and an adhesive between the exposed rear portion of said bottom wall panel end flap and said rear wall panel end flap which extends within the recess in said cover wall panel end flap to thereby capture the marginal edge portion of said cover wall panel end flap between the outer edge portion of said rear wall panel end flap and the upper rear corner portion of said bottom wall panel end flap while enabling the marginal edge portion of said cover wall panel end flap to move unobstructively relative thereto.

2. A carton as defined in claim 1, wherein said front flap wall panel includes an opening means for selectively detaching a portion of said front flap wall panel from said front wall panel during a manual cover wall panel opening procedure.

3. A carton as defined in claim 1, wherein said adhesive is also disposed on an outer edge portion of said front wall panel end flap.

4. A carton as defined in claim 1, wherein said bottom wall panel end flaps have a length slightly smaller than a width of said bottom wall panel.

5. A carton as defined in claim 1, wherein the end flaps forming each end assembly are devoid of lips extending under said cover wall panel.

6. A carton as defined in claim 1, wherein one of said exposed rear portion of bottom wall panel end flaps and an interior surface of said rear wall panel end flaps corresponding thereto includes at least one embossed portion for facilitating adhesive attachment between said exposed rear portion of said bottom wall panel end flaps and said rear wall panel end flaps, said embossed portion providing a protruding surface from one of said exposed rear portion of said bottom wall panel end flaps and said interior surface of said rear wall panel end flaps for maintaining a surface-to-surface abutting relation between a surface of said embossed portion and an adjacent surface thereto as a result of said end assembly being in said closed position, said adjacent surface being the other of said exposed rear portion of said bottom wall panel end flaps and said interior surface of said rear wall panel end flaps.

7. A carton as defined in claim 6, wherein said upper portion of said rear wall panel end flaps include a generally arcuate corner arrangement having a central embossed portion disposed on an interior surface thereof such that said central embossed portion is capable of being positioned outside said marginal edge portion as a result of said end assembly being in said closed position, said central embossed portion adapted to facilitate the adhesive attachment of said upper portion of said rear wall panel end flaps to said exposed rear portion of said bottom wall panel end flaps corresponding to said recessed portion by providing an interior surface portion of said rear wall panel end flaps in close proximity to exposed rear portion of said bottom wall panel end flaps to compensate for a thickness of carton material disposed between said upper portion of said rear wall panel end flaps and said exposed rear portion of said bottom wall panel end flaps as a result of said end assembly being in said closed position.

8. A carton as defined in claim 7, wherein said exposed rear portion of bottom wall panel end flaps include a bottom wall panel end flap embossed portion disposed thereon such that said bottom wall panel end flap embossed portion is capable of being positioned adjacent said central embossed portion and a middle and lower portion of said rear wall panel end flaps as a result of said end assembly being in said closed position.

9. A carton as defined in claim 8, wherein said central embossed portion is generally rectangular and is disposed on said rear wall panel end flaps in a generally parallel relation with said rear wall panel end flap fold lines, said central embossed portion having an upper portion capable of being positioned proximate to and outside or said marginal edge portion of said cover wall panel end flaps as a result of said end assembly being in said closed position, and a lower portion terminating along a line corresponding to an outer edge of said cover wall panel end flaps as a result of said end assembly being in said closed position, and said bottom wall panel end flap embossed portion is generally rectangular and disposed on said exposed rear portion of said bottom wall panel end flaps such that said embossed portion is generally parallel to said rear wall panel end flap fold lines and said bottom wall panel end flap fold lines as a result of said end assembly being in said closed position.

10. A carton as defined in claim 9, further comprising a protruding lip portion hingedly connected to said front wall panel along a lip fold line such that said protruding lip portion abuts an interior edge portion of said cover wall panel proximate to said front a flap wall panel fold line, and is biased into engagement with said interior edge portion of said cover wall panel thereby enhancing sealing of said carton tube along said front flap wall panel fold line.

11. A carton of as defined in claim 1, further comprising a protruding lip portion hingedly connected to said front wall panel along a lip fold line such that said protruding lip portion abuts an interior edge portion of said cover wall panel proximate to said front flap wall panel fold line, and is biased into engagement with said interior edge portion of said cover wall panel thereby enhancing sealing of said carton tube along said front flap wall panel fold line.

12. A carton as defined in claim 2, wherein said opening means for selectivity detaching a portion of front flap wall panel hingedly connected to said cover wall panel from said front wall panel comprises a tear-away strip defined by a series of parallel perforations along a predetermined perforation path formed in said front flap wall panel.

13. A carton package containing ice cream and the like therein, said carton package including a carton comprising:

a bottom wall panel, a front wall panel hingedly connected to said bottom wall panel, a rear wall panel hingedly connected to said bottom wall panel, a cover wall panel hingedly connected to said rear wall panel, and a front flap wall panel hingedly connected to said cover wall panel along a front flap wall panel fold line and adhered to the front wall panel; and a pair of end assemblies enclosing end portions of said carton, said end assemblies including bottom wall panel end flaps hingedly connected to said bottom wall panel, front wall panel end flaps hingedly connected to said front wall panel, cover wall panel end flaps hingedly connected to said cover wall panel, rear wall panel end flaps hingedly connected to said rear wall panel, and front flap wall panel end flaps hingedly connected to said front flap wall panel, the end flaps forming each of said end assemblies having been moved in the following order into a closed position over the end portions of the carton, (1) said bottom wall panel end flap first moved such that said bottom wall panel end flap substantially closes an end portion of the carton, (2) next said front wall panel end flap moved such that said front wall panel end flap overlaps a front portion of said bottom wall panel end flap with a rear portion exposed, (3) then the cover wall panel end flap including a recess in a rear lower corner thereof moved such that said cover wall panel end flap overlaps an upper portion of said front wall panel end flap and an upper rear corner portion of said bottom wall panel end flap with said recess leaving exposed an upper portion of the exposed portion of the bottom wall panel end flap below the overlapped upper rear corner portion and rearwardly of the overlapped upper portion thereof, (4) then the rear wall panel end flap moved such that an outer edge portion of said rear wall panel end flap overlaps a marginal edge portion of the cover wall panel end flap defining said recess, a rear portion of said front wall panel end flap, and substantially the entire exposed rear portion of said bottom wall panel end flap, (5) finally the front flap wall panel end flap moved such that said front flap wall panel end flap overlaps a front portion of said cover wall panel end flap, and the end flaps forming each of said end assemblies being maintained in said closed position by an adhesive between the front portion of said cover wall panel end flap and said front flap wall panel end flap and an adhesive between the exposed rear portion of said bottom wall panel end flap and said rear wall panel end flap which extends within the recess of said cover wall panel end flap to thereby capture the marginal edge portion of said cover wall panel end flap between the outer edge portion of said rear wall panel end flap and the upper rear corner portion of said bottom wall panel end flap while enabling the marginal edge portion of said cover wall panel end flap to move unobstructively relative thereto.

14. A carton package as defined in claim 13, wherein said front flap wall panel includes an opening means for selectively detaching a portion of said front flap wall panel from said front wall panel during a manual cover wall panel opening procedure.

15. A carton package as defined in claim 13, wherein said adhesive is also disposed on an outer edge portion of said front wall panel end flap.

16. A carton package as defined in claim 13, wherein the end flaps forming each end assembly are devoid of lips extending under said cover wall panel.

17. A carton package as defined in claim 13, wherein one of said exposed rear portion of said bottom wall panel end flaps and an interior surface of said rear wall panel end flaps include at least one embossed portion thereon for facilitating adhesive attachment between said second area of said bottom wall panel end flaps and said rear wall panel end flaps, said embossed portion providing a protruding surface from one of said exposed rear portion of said bottom wall panel end flaps and said interior surface of said rear wall panel end flaps thereby forming a surface-to-surface abutting relation between a surface of said embossed portion and an adjacent surface, said adjacent surface being the other of said exposed rear portion of said bottom wall panel end flaps and said interior surface of said rear wall panel end flaps.

18. A carton package as defined in claim 17, wherein said upper portion of said rear wall panel end flaps include a generally arcuate corner arrangement having a central embossed portion disposed on an interior surface thereof such that said central embossed portion is positioned outside said marginal edge portion, said central embossed portion facilitating said adhesive attachment of said upper portion of said rear wall panel end flaps to said upper portion of said exposed rear portion of said bottom wall panel end flaps corresponding to said recess by providing an interior surface portion of said rear wall panel end flaps in close proximity to said upper portion of said exposed rear portion of said bottom wall panel end flaps to compensate for a thickness of carton material disposed between said upper portion of said rear wall panel end flaps and said bottom wall panel end flaps.

19. A carton package as defined in claim 18, wherein said exposed rear portion of bottom wall panel end flaps include a bottom wall panel end flap embossed portion disposed on an exterior surface thereof such that said embossed portion is positioned adjacent said central embossed portion of said rear wall panel end flaps and adjacent a middle and lower portion of said rear wall panel end flaps.

20. A carton package as defined in claim 19, wherein said central embossed portion is generally rectangular and disposed on said rear wall panel end flaps in a generally parallel relation with said rear wall panel end flap fold lines, said central embossed portion having an upper portion positioned proximate to said outer edge of said recess and a lower portion terminating along a line corresponding to an outer edge of said cover wall panel end flaps, and said bottom wall panel end flap embossed portion is generally rectangular and disposed on said exposed rear portion of said bottom wall panel end flaps such that said bottom wall panel end flap embossed portion is generally parallel to said rear wall panel end flap fold lines and said bottom wall panel end flap fold lines.

21. A carton package as defined in claim 20, further comprising a protruding lip portion hingedly connected to said front wall panel along a lip fold line such that said protruding lip portion abuts an interior edge portion of said cover wall panel proximate to said front flap wall panel fold line and is biased into engagement with said interior edge portion of said cover wall panel thereby enhancing sealing of said carton along said front flap wall panel fold line.

22. A carton package as defined in claim 13, further comprising a protruding lip portion hingedly connected to said front wall panel along a lip fold line such that said protruding lip portion abuts an interior edge portion of said cover wall panel proximate to said front flap wall panel fold line and is biased into engagement with said interior edge portion of said cover wall panel thereby enhancing sealing of said carton along said front flap wall panel fold line.

23. A carton for containing ice cream or the like erected from a collapsed carton tube formed from a carton blank, said carton comprising:

a bottom wall panel, a front wall panel hingedly connected to said bottom wall panel, a rear wall panel hingedly connected to said bottom wall panel, a cover wall panel hingedly connected to said rear wall panel, and a front flap wall panel hingedly connected to said cover wall panel along a front flap wall panel fold line and adhered to the front wall panel to form a collapsed parallelogram adapted to be opened up into a carton tube; and a pair of end assemblies enclosing end portions of said carton, said end assemblies including bottom wall panel end flaps hingedly connected to said bottom wall panel, front wall panel end flaps hingedly connected to said front wall panel, cover wall panel end flaps hingedly connected to said cover wall panel, rear wall panel end flaps hingedly connected to said rear wall panel, and front flap wall panel end flaps hingedly connected to said front flap wall panel, the end flaps forming one end assembly have been moved to a closed position prior to filling said carton and the end flaps forming another end assembly have been moved in the following order into a closed position after said carton has been filled, (1) said bottom wall panel end flap first being moved such that said bottom wall panel end flap substantially closes the end portion of the carton, (2) next said front wall panel end flap being moved such that said front wall panel end flaps overlaps a front portion of said bottom wall panel end flap with a rear portion exposed, (3) then the cover wall panel end flap including a recess in a rear lower corner thereof being moved such that said cover wall panel end flap overlaps an upper portion of said front wall panel end flap and an upper rear corner portion of said bottom wall panel end flap with said recess leaving exposed an upper portion of the exposed rear portion of said bottom wall panel end flap below the overlapped upper rear corner portion and rearwardly of the overlapped upper portion thereof, (4) then the rear wall panel end flap being moved such that an outer edge portion of said rear wall panel end flap overlaps a marginal edge portion of the cover wall panel end flap defining said recess, a rear portion of said front wall panel end flap, and substantially the entire exposed rear portion of said bottom wall panel end flap, and (5) finally the front flap wall panel end flap being moved such that said front flap wall panel end flap overlaps a front portion of said cover wall panel end flap, the end flaps forming said another end assembly being maintained in said closed position by an adhesive between the front portion of said cover wall panel end flap and said front flap wall panel end flap and an adhesive between the exposed rear portion of said bottom wall panel end flap and said rear wall panel end flap which extends within the recess in said cover wall panel end flap to thereby capture the marginal edge portion of said cover wall panel end flap between the outer edge portion of said rear wall panel end flap and the upper rear corner portion of said bottom wall panel end flap while enabling the marginal edge portion of said cover wall panel end flap to move unobstructively relative thereto.

24. A carton as defined in claim 23, wherein the end flaps forming said another end assembly are devoid of lips extending under said cover wall panel.

25. A carton package containing ice cream and the like therein, said carton package including a carton comprising:

a bottom wall panel, a front wall panel hingedly connected to said bottom wall panel, a rear wall panel hingedly connected to said bottom wall panel, a cover wall panel hingedly connected to said rear wall panel, and a front flap wall panel hingedly connected to said cover wall panel along a front flap wall panel fold line and adhered to the front wall panel; and a pair of end assemblies enclosing end portions of said carton .package, said end assemblies including bottom wall panel end flaps hingedly connected to said bottom wall panel, front wall panel end flaps hingedly connected to said front wall panel, cover wall panel end flaps hingedly connected to said cover wall panel, rear wall panel end flaps hingedly connected to said rear wall panel, and front flap wall panel end flaps hingedly connected to said front flap wall panel, the end flaps forming one end assembly have been moved into a closed position over one end portion of the carton prior to filling said carton with ice cream or the like and the end flaps forming another end assembly have been moved in the following order into a closed position after said carton has been filled, (1) said bottom wall panel end flap first moved such that said bottom wall panel end flap substantially closes the associated end portion of the carton, (2) next said front wall panel end flap moved such that said front wall panel end flap overlaps a front portion of said bottom wall panel end flap with a rear portion exposed, (3) then the cover wall panel end flap including a recess in a rear lower corner thereof moved such that said cover wall panel end flap overlaps an upper portion of said front wall panel end flap and an upper rear corner portion of said bottom wall panel end flap with said recess leaving exposed an upper portion of the exposed portion of the bottom wall panel end flap below the overlapped upper rear corner portion and rearwardly of the overlapped upper portion thereof, (4) then the rear wall panel end flap moved such that an outer edge portion of said rear wall panel end flap overlaps a marginal edge portion of the cover wall panel end flap defining said recess, a rear portion of said front wall panel end flap, and substantially the entire exposed rear portion of said bottom wall panel end flap, (5) finally the front flap wall panel end flap moved such that said front flap wall panel end flap overlaps a front portion of said cover wall panel end flap, and the end flaps forming said another end assembly being maintained in said closed position by an adhesive between the front portion of said cover wall panel end flap and said front flap wall panel end flap and an adhesive between the exposed rear portion of said bottom wall panel end flap and said rear wall panel end flap which extends within the recess in said cover wall panel end flap to thereby capture the marginal edge portion of said cover wall panel end flap between the outer edge portion of said rear wall panel end flap and the upper rear corner portion of said bottom wall panel end flap while enabling the marginal edge portion of said cover wall panel end flap to move unobstructively relative thereto.

26. A carton package as defined in claim 25, wherein the end flaps forming said another end assembly are devoid of lips extending under said cover wall panel.

27. A carton for containing ice cream or the like erected from a collapsed carton tube, said carton comprising:

a bottom wall panel, a front wall panel hingedly connected to said bottom wall panel, a rear wall panel hingedly connected to said bottom wall panel, a cover wall panel hingedly connected to said rear wall panel, and a front flap wall panel hingedly connected to said cover wall panel and adhered to the front wall panel to form a collapsed parallelogram adapted to be opened up into said carton tube; and a pair of end assemblies enclosing end portions of said carton, said end assemblies including bottom wall panel end flaps hingedly connected to said bottom wall panel, front wall panel end flaps hingedly connected to said front wall panel along front wall panel end flap fold lines, cover wall panel end flaps hingedly connected to said cover wall panel along cover wall panel end flap fold lines, rear wall panel end flaps hingedly connected to said rear wall panel, and front flap wall panel end flaps hingedly connected to said front flap wall panel, at least one of said cover wall panel end flap fold lines being a reverse barscore as viewed from the side of the carton forming the exterior surface thereof, said reverse barscore being constructed and arranged to enable the associated cover wall panel end flaps to be folded outward from said carton as said carton with one end assembly closed enters a carton filling station to prevent the carton from tilting under a filling head thereby reducing malfunctions occurring during filling of the carton, said bottom wall panel end flap having a width slightly larger than a width of said rear wall panel such that an outer edge of said bottom wall panel end flap overlaps an inner portion of said reverse barscore when said bottom wall panel is moved into said closed position over said end portion of said carton, and said reverse barscore providing a concave groove receiving said outer edge of said bottom wall panel end flap therein.

28. A carton as defined in claim 27, wherein the end flaps forming said one of said end assemblies are devoid of lips extending under said cover wall panel.

29. A carton as defined in claim 27, wherein the end flaps forming said one of said end assemblies have been moved in the following order into a closed position over the one end portion of the carton, (1) said bottom wall panel end flap first being moved such that said bottom wall panel end flap substantially closes the associated end portion of the carton tube, (2) next said front wall panel end flap being moved such that said front wall panel end flap overlaps a front portion of said bottom wall panel end flap with a rear portion exposed, (3) then the cover wall panel end flap including a recess in a rear lower corner thereof being moved such that said cover wall panel end flap overlaps an upper portion of said front wall panel end flap and an upper rear corner portion of said bottom wall panel end flap with said recess leaving exposed an upper portion of the exposed rear portion of said bottom wall panel end flap below the overlapped upper rear corner portion and rearwardly of the overlapped upper portion thereof, (4) then the rear wall panel end flap being moved such that an outer edge portion of said rear wall panel end flap overlaps a marginal edge portion of the cover wall panel end flap defining said recess, a rear portion of said front wall panel end flap, and substantially the entire exposed rear portion of said bottom wall panel end flap, and (5) finally the front flap wall panel end flap being moved such that said front flap wall panel end flap overlaps a front portion of said cover wall panel end flap, the end flaps forming said one end assembly being maintained in said closed position by an adhesive between the front portion of said cover wall panel end flap and said front flap wall panel end flap and an adhesive between the exposed rear portion of said bottom wall panel and said rear wall panel end flap which extends within the recess in said cover wall panel end flap to thereby capture the marginal edge portion of said cover wall panel end flap between the outer edge portion of said rear wall panel end flap and the upper rear corner portion of said bottom wall panel end flap while enabling the marginal edge portion of said cover wall panel end flap to move unobstructively relative thereto.

30. A carton as defined in claim 29, wherein a length of said bottom wall panel end flap is slightly less than a width of said bottom wall panel.

31. A carton as defined in claim 30, wherein said front flap wall panel includes an opening means for selectively detaching a portion of said front flap wall panel from said front wall panel during a manual cover wall panel opening procedure.

32. A carton as defined in claim 31, wherein one of the exposed rear portion of said bottom wall panel end flap and an interior surface of said rear wall panel end flap corresponding thereto includes at least one embossed portion for facilitating adhesive attachment between the exposed rear portion of said bottom wall panel end flap and said rear wall panel end flap, said embossed portion providing a protruding surface from one of the exposed rear portion of said bottom wall panel end flap and said interior surface of said rear wall panel end flap for maintaining a surface-to-surface abutting relation between a surface of said embossed portion and an adjacent surface thereto as a result of said one end assembly being in said closed position, said adjacent surface being the other of the exposed rear portion of said bottom wall panel end flap and said interior surface of said rear wall panel end flap.

33. A carton as defined in claim 32, wherein the upper portion of said rear wall panel end flap includes a generally arcuate corner arrangement having a central embossed portion disposed on an interior surface thereof such that said central embossed portion is capable of being positioned outside said marginal edge portion as a result of said one end assembly being in said closed position, said central embossed portion adapted to facilitate the adhesive attachment of the upper portion of said rear wall panel end flap to the exposed rear portion of said bottom wall panel end flap corresponding to said recess by providing an interior surface portion of said rear wall panel end flap in close proximity to the exposed rear portion of said bottom wall panel end flap to compensate for a thickness of carton material disposed between the upper portion of said rear wall panel end flap and the exposed rear portion of said bottom wall panel end flap as a result of said one end assembly being in said closed position.

34. A carton as defined in claim 33, wherein the exposed rear portion of bottom wall panel end flap includes a bottom wall panel end flap embossed portion disposed thereon such that said bottom wall panel end flap embossed portion is capable of being positioned adjacent said central embossed portion and a middle and lower portion of said rear wall panel end flap as a result of said one end assembly being in said closed position.

* * * * *